US012110643B2

(12) United States Patent
Mereu

(10) Patent No.: US 12,110,643 B2
(45) Date of Patent: Oct. 8, 2024

(54) MODULAR STREET BARRIER SYSTEM

(71) Applicant: Good Job S.R.L., Florence (IT)

(72) Inventor: Francesco Mereu, Prato (IT)

(73) Assignee: Good Job S.R.L., Florence (IT)

( * ) Notice: Subject to any disclaimer, the term of this patent is extended or adjusted under 35 U.S.C. 154(b) by 659 days.

(21) Appl. No.: 17/431,759

(22) PCT Filed: Feb. 17, 2020

(86) PCT No.: PCT/IT2020/050028

§ 371 (c)(1),
(2) Date: Aug. 18, 2021

(87) PCT Pub. No.: WO2020/170282

PCT Pub. Date: Aug. 27, 2020

(65) Prior Publication Data

US 2022/0145557 A1 May 12, 2022

(30) Foreign Application Priority Data

Feb. 22, 2019 (IT) ..... 102019000002589

(51) Int. Cl.
*E01F 13/12* (2006.01)

(52) U.S. Cl.
CPC ..... *E01F 13/12* (2013.01)

(58) Field of Classification Search
CPC ..... E01F 13/12; E01F 15/00; E01F 15/003; E01F 15/0407; E01F 15/006; E01F 13/02; E01F 13/028; E01F 13/046; E01F 13/06
See application file for complete search history.

(56) References Cited

U.S. PATENT DOCUMENTS

| | | | | |
|---|---|---|---|---|
| 9,127,421 | B2 * | 9/2015 | Ball | E01F 15/003 |
| 9,133,590 | B2 * | 9/2015 | Ball | E01F 15/003 |
| 9,683,340 | B2 * | 6/2017 | Sicking | E01F 15/003 |
| 10,415,198 | B1 * | 9/2019 | Thomas | E01F 13/12 |
| 10,662,597 | B2 * | 5/2020 | Neusch | E01F 13/02 |
| 2014/0003867 | A1 * | 1/2014 | Ball | E01F 15/003 404/6 |
| 2014/0010591 | A1 * | 1/2014 | Ball | E01F 13/12 404/6 |
| 2020/0063387 | A1 * | 2/2020 | Klein | E01F 13/022 |
| 2020/0340194 | A1 * | 10/2020 | Klein | E01F 13/12 |
| 2020/0378078 | A1 * | 12/2020 | Weissberg | F41H 11/08 |
| 2020/0393219 | A1 * | 12/2020 | Downing | E01F 13/12 |
| 2022/0056652 | A1 * | 2/2022 | Weissberg | F41H 11/08 |

(Continued)

FOREIGN PATENT DOCUMENTS

| | | |
|---|---|---|
| CN | 206495156 U | 9/2017 |
| CZ | 2006837 A3 | 7/2008 |

(Continued)

OTHER PUBLICATIONS

International Search Report and Written Opinion, PCT/IT2020/050028, Apr. 6, 2020.

*Primary Examiner* — Abigail A Risic
(74) *Attorney, Agent, or Firm* — Nancy J. Flint, Attorney At Law, P.A.; Nancy J. Flint, Esq.

(57) ABSTRACT

A modular street barrier system comprising a plurality of L-shaped modules lying on parallel vertical planes and connected to each other by way of a plurality of rods and by a flexible thread-like element.

20 Claims, 4 Drawing Sheets

(56) References Cited

U.S. PATENT DOCUMENTS

| | | | | |
|---|---|---|---|---|
| 2022/0298733 | A1* | 9/2022 | Graziadei | E01F 13/12 |
| 2023/0349116 | A1* | 11/2023 | Whitford | E01F 13/02 |

FOREIGN PATENT DOCUMENTS

| | | | |
|---|---|---|---|
| EP | 3323842 | A1 | 5/2018 |
| WO | 2016030886 | A1 | 3/2016 |
| WO | 2019016812 | A1 | 1/2019 |

* cited by examiner

MODULAR STREET BARRIER SYSTEM

TECHNICAL FIELD

The present invention belongs to the sector of street barriers, in particular removable street barriers, which are used to temporarily prevent vehicles from passing therethrough.

More specifically, the present invention belongs to the sector of movable street barrier, which can be rapidly laid out and easily removed, without any need for civil works and without permanently modifying the roadbed.

In particular, the present invention belongs to the sector of movable street barriers capable of preventing a vehicle from moving after having stopped its race.

PRESENT STATE OF THE ART

A need is felt of having devices capable of quickly creating vehicle barriers; in particular, a need is felt for having barriers that can stop heavy vehicles such as, for instance, vans and trucks.

Vehicle barriers are known of a heavy type, which are made of concrete, both capable of being stably secured to the ground and of a movable type; however, due to the very high mass of the latter, its movement is very time consuming and needs appropriate lifting and transportation means. Hence, these barriers are inappropriate to respond to temporary nature needs. Moreover, barriers of this type cannot be removed quickly not even in the event that a passage has to be opened, for instance to allow emergency vehicles to pass through.

These are the reasons why removable vehicle barriers have been developed; however, the latter, after the impact, cannot always adequately retain large vehicles and, moreover, these barriers have often different stopping efficiency depending if the vehicle to be stopped is a front-drive or a rear-drive vehicle.

The movable barriers very often comprise elements specifically designed for damaging the vehicle tires, thus avoiding the latter from not only continuing its race, but also from reversing and leaving; the lower portion of the movable vehicle barriers often also comprises elements destined to be stuck into the ground, in order to increase the friction between the barrier and the ground.

Chinese utility model CN206495156U describes a barrier comprising a plurality of L-shaped elements, from which are projected points intended to puncture tires. WO 2016/030886 describes a modular barrier having a plurality of foldable elements which, when opened assume an L-shape. US2010/0290833 shows a modular movable barrier comprising a plurality of L-shaped elements.

OBJECTS AND SUMMARY OF THE INVENTION

The modular street barrier according to the present invention aims at blocking up vehicles which impact against them and, simultaneously, at enabling a quick and easy positioning, without the need for lifting means, so that, if necessary, the barrier can be quickly moved in order to let vehicles pass through.

A further object of the modular barrier according to the present invention is that of being capable of stopping the vehicle after the impact, thus reducing the risk of it disengaging and leaving.

These objects and others, which will be apparent to a person skilled in the art from reading the following text, are achieved by a modular street barrier comprising a plurality of L-shaped modules, each of which lies on a vertical plane, parallel to those on which the remaining L-shaped modules lie.

The several modules are connected to each other by way of a number of rigid rods, for instance the upright elements can be connected to each other via two rods that form an X, and the horizontal elements can be connected to each other via rods lying on the ground and feature a side bristling with points, in order to damage the tires of a vehicles which might impact against them.

A particularly innovative aspect of the present barrier is in that the various modules are connected to each other also via a flexible non-extensible thread-like element such as, for instance, a metal cable; should a vehicle impact the barrier, the metal cable determines an effect thanks to which the portion of the barrier that exceeds the volume of the vehicle arranges itself around the latter, encircling it and preventing it both from moving and, for instance, from its doors opening.

In the impact dynamics the L-shaped modules provide the strength necessary to counteract the vehicle impact, whereas the means connecting the L-shaped modules deform and contribute to absorb the kinetic energy of the vehicle, preventing the latter from jumping across the barrier, by deviating the race line.

Figure 1:
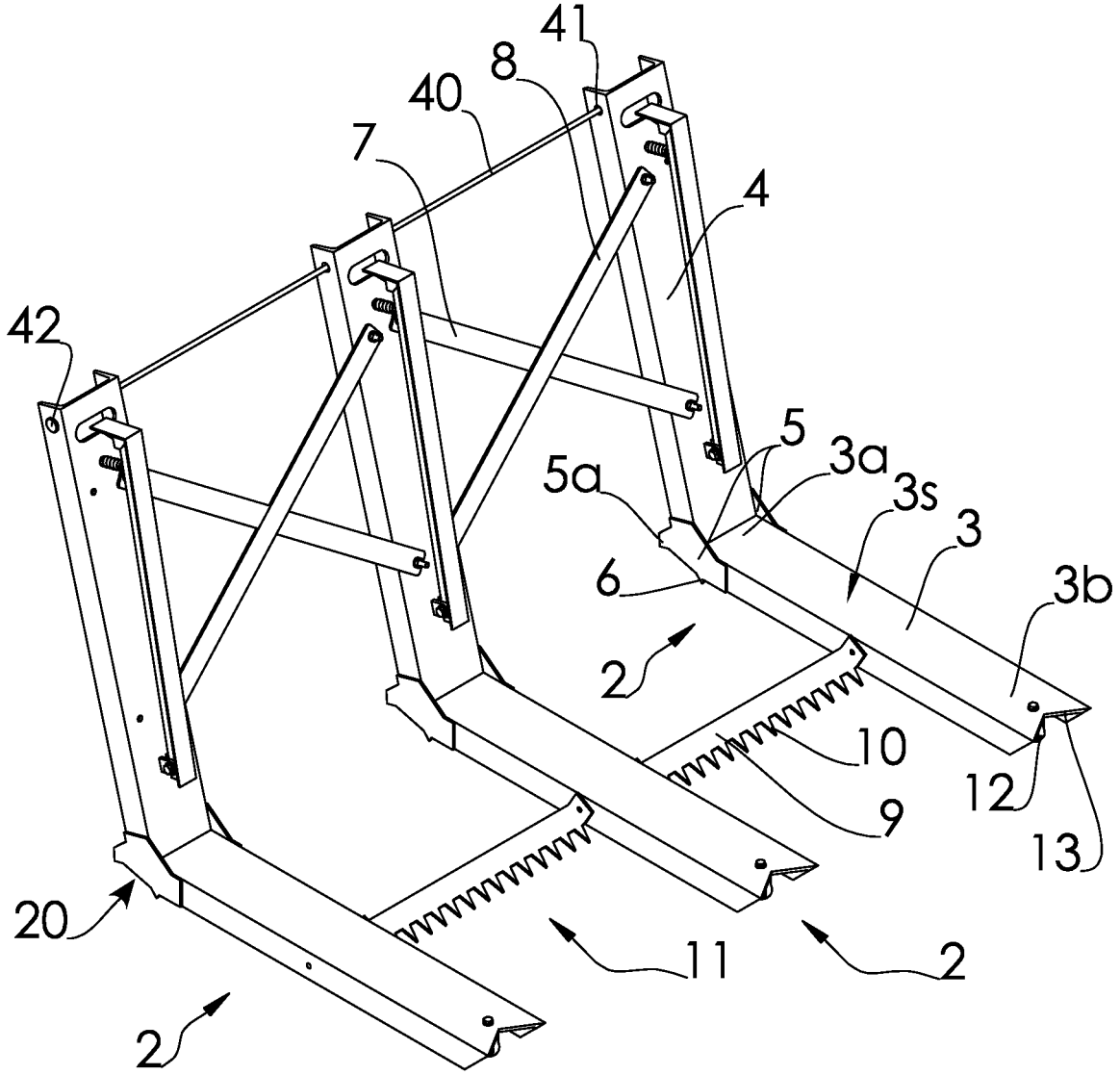
FIG. 1 shows a perspective view of a modular street barrier according to the present invention in a configuration comprising three modules (2). In particular, each barrier module (2) comprises a first horizontal element (3), which lies on the ground, and a second upright element (4), which rises in correspondence with a longitudinal end of the first element (3).

Both the first and the second elements (3 and 4) are connected with the same elements of the adjacent module through a plurality of rods (7, 8, 9) and the upper ends of the second upright elements (4) are connected to each other through a thread-like flexible and non-extensible element (40), slidingly coupled inside appropriate holes (41) located in correspondence with the upper part of said second upright elements (4).

Figure 2:
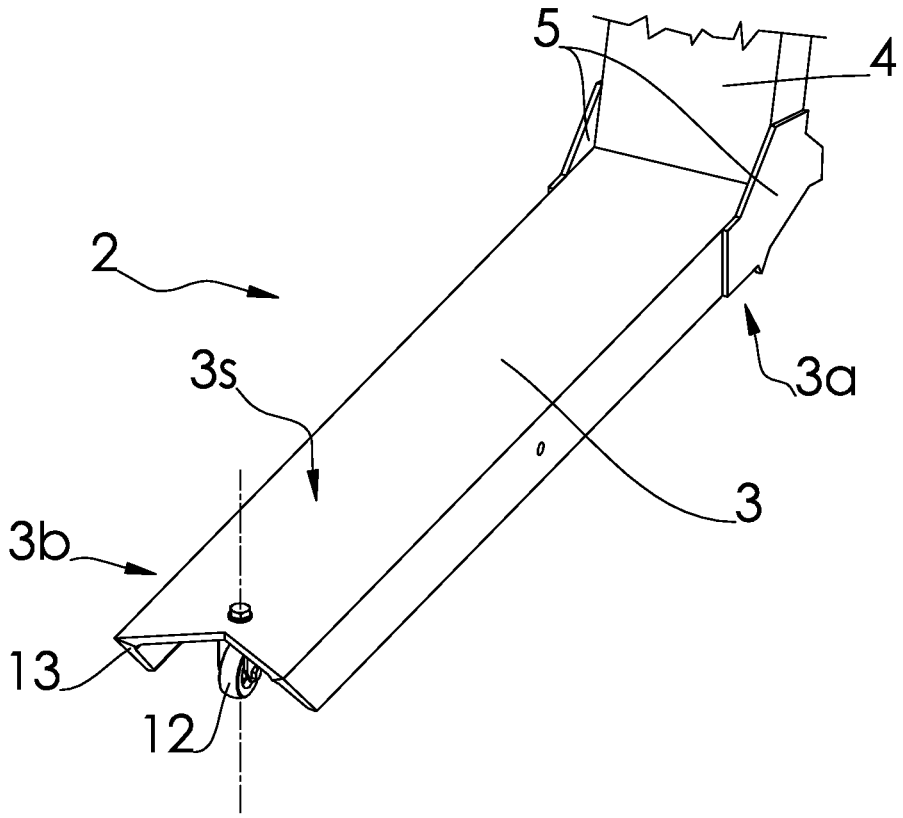
Figure 3:
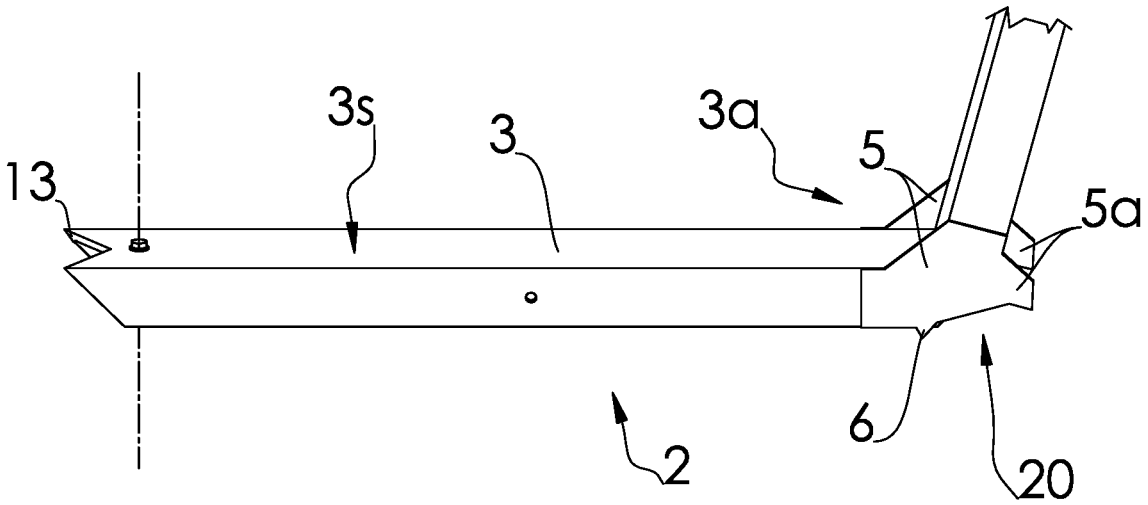

FIG. 2 and FIG. 3 show, in detail, the horizontal element (3), in particular the figures show rolling member (12) and the end (3*b*) shaped like a beak.

Figure 4:
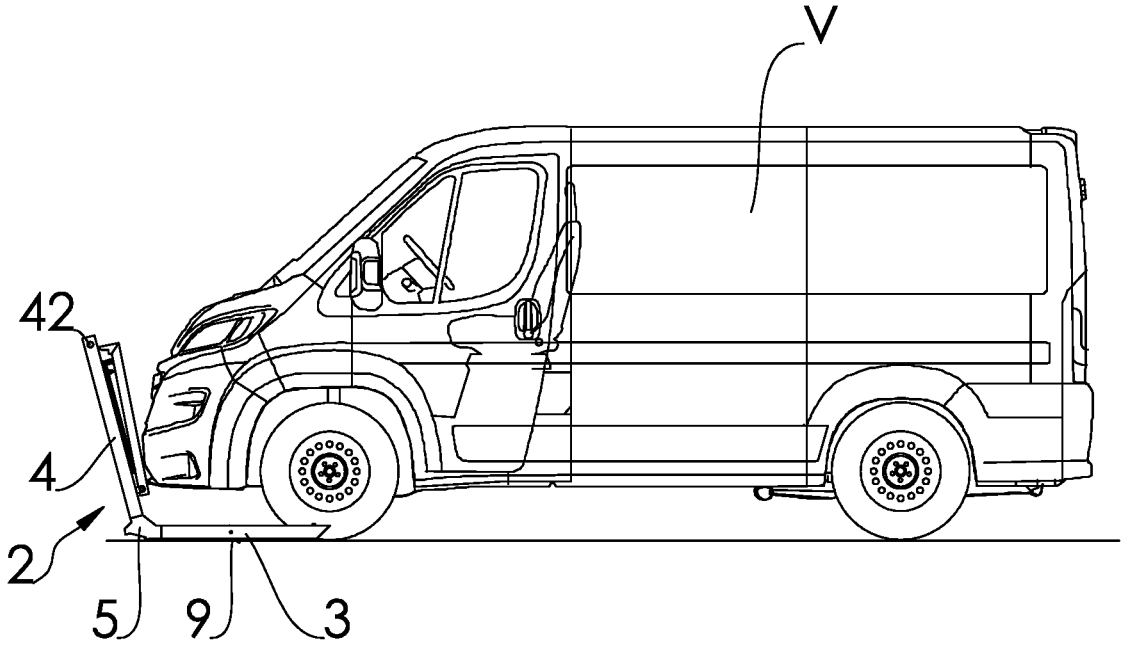
Figure 5:
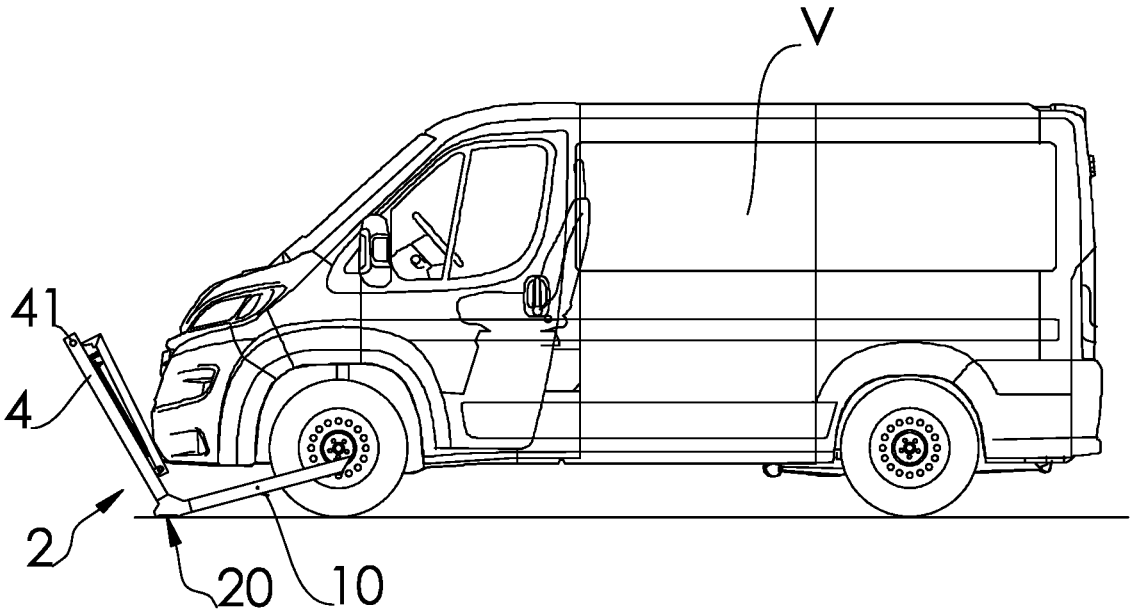

FIG. 4 and FIG. 5 show two successive steps of the impact of a vehicle (V) against the barrier.

Figure 6:
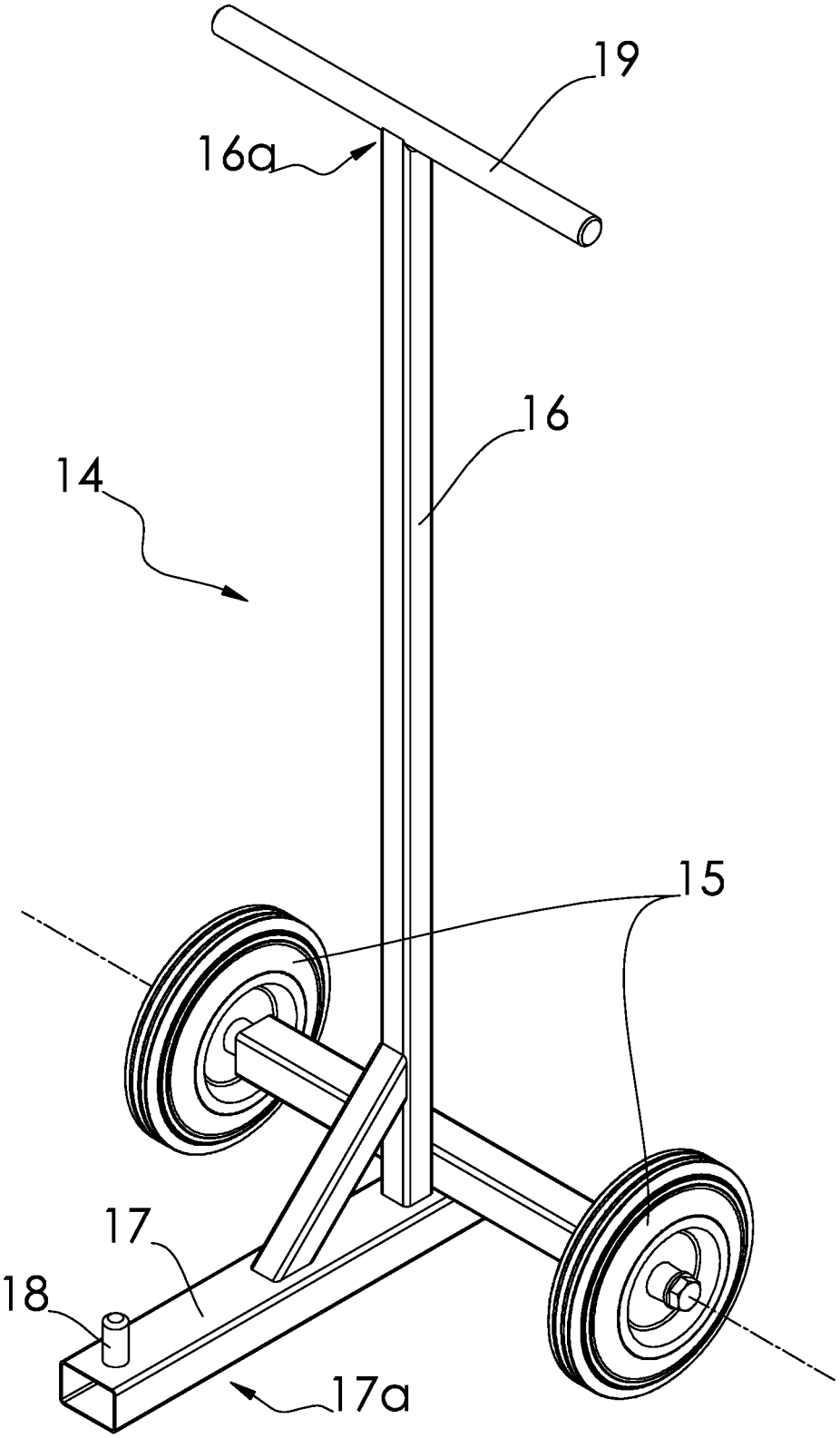

FIG. 6 shows a trolley (14).

DETAILED DESCRIPTION OF AN EMBODIMENT OF THE INVENTION

In accordance with a preferred embodiment, the modular street barrier system according to the present invention comprises a plurality of L-shape modules, each of which has a first horizontal element (3) which lays on the ground, with a first free end (3*a*) and a second end (3*b*) in correspondence with which a second upright element (4) rises.

Both the first and the second elements (3 and 4) are connected to each other through a plurality of rods (7, 8, 9) featuring an elongate shape and, according to a preferred embodiment, are made from box-like profiles; advantageously the first horizontal element (3) can be made from a quadrangular cross section metal profile, whereas the second upright element (4) can be preferably made from a metal profile featuring a C-shape cross section.

In correspondence with the connection between the first horizontal element (3) and the second upright element (4) there are two bilaterally arranged respective reinforcing plates (5), the latter being advantageously made from a metal sheet and welded to both said first and second elements (3, 4).

The projecting portion (5*a*) is peak-shaped so as to digs into the ground on which lays the first horizontal element (3); below the plate (5) a tooth (6) is projected, also suitable for being stuck into the ground, in order to avoid the barrier module (2) from making sliding movements.

The projecting portion (5*a*) and the tooth (6) collectively define anchoring means (20) to be anchored to the ground, suitable for preventing the barrier module (2) from sliding on the ground and for also helping its overturning around the fulcrum formed of the portion (5*a*).

In order to connect two adjacent barrier modules (2) to each other, a first rod (7) and a second rod (8) are used, which are arranged non-parallel to each other and are reversibly connected, with its own opposite longitudinal ends (15), to one and the other of such two adjacent barrier modules (2) respectively.

In particular, each rod (7, 8), the first rod and the second rod, features respective opposite longitudinal ends, connected to the second upright elements (4) of the two adjacent barrier modules (2) by way of thread members of a known type.

Advantageously, the two rods (7, 8), the first and the second one, are reciprocally arranged in a X configuration and are made from a metal profile of a flat type, featuring a prevalently longitudinal development and a rectangular cross section wherein a side is much bigger than the other one. Two adjacent modules (2) are also connected to each other by way of a horizontal rod (9), which joins together its respective first horizontal elements (3); likewise to the first and second rods (7, 8), also the horizontal rod (9) features respective opposite longitudinal ends connected to the first horizontal elements (3) by way of members of a known type.

Conveniently, the horizontal rod (9) is arranged in such a way as to connect to each other the respective median zones of the first horizontal elements (3) of two adjacent barrier modules (2).

According to a particularly effective embodiment, the above-mentioned horizontal rod (9) features a plurality of points (10) suitable for perforating a tire of a vehicle should it get in contact therewith. Advantageously, the horizontal rod (9) is made of a metal profile of a flat type and is mounted so that the developing plane of its respective flat profile is inclined to the ground, so that the points (10) are facing the ground itself when the barrier is in the normal position, whereas the points themselves are facing the advancing direction of the vehicle after the impact of the latter has caused the rotation of the barrier.

In order to assure this effect, the horizontal rod (9) is put in correspondence with the median zone of the first horizontal elements (3).

The mentioned first rod (7), second rod (8), and horizontal rod (9) collectively define connection means (11) for connecting a number of barrier modules (2) to each other.

In correspondence with its own second longitudinal end (3*b*) opposite to the mentioned first longitudinal end (3*a*), the first horizontal element (3) is shaped like a beak, i.e. features, in correspondence with its second longitudinal end (3*b*), a respective end edge (13), so that the box-like profile defining the first horizontal element (3) is cut, in correspondence with its own end (3*b*), according to an inclined plane incident to the ground and such as to define a projecting upper part and a recessing lower part.

In correspondence with the second longitudinal end (3*b*) of the first horizontal element (3) is arranged a rolling member (12), arranged in such a way as to not get in contact with the ground when the first horizontal element (3) is in contact with the ground.

The rolling member (12) is also arranged in such a way as to get in contact with the ground when the respective module (2) in correspondence with the first longitudinal end (3*a*) of the first horizontal element (3) is raised, even partially, from the ground.

Advantageously, the rolling member (12) is of a pivoting type according to a vertical oscillation axis and is accommodated, at least partially, inside the box-like metal profile of the first horizontal element (3).

The several modules (2) are connected to each other by way of a flexible non-extensible thread-like element (40), such as, for instance, a metal cable, which passes through appropriate holes (41) cut in proximity of the upper end of the second upright elements (4); in the illustrated embodiment, the flexible thread-like element (40) slidingly goes through all the intermediate modules, but other solutions are also possible wherein the flexible thread-like element passes through only a part of the intermediate modules.

Conversely, the flexible thread-like element (40) is integrally connected to the two end modules of the barrier; it goes without saying that within the present inventive principle configurations also fall wherein the modular barrier system comprises further side modules, which are not passed through by the flexible thread-like element (40).

It is also worth remembering that the modular street barrier system according to the present invention also comprises a special trolley (14), especially designed for lifting one or more barrier modules (2).

The trolley (14) is configured for engaging a module (2) in order to facilitate the barrier movement: for this purpose, it is worth pointing out that the best results are achieved when the barrier system comprises an odd number of modules (2) and the trolley (14) engages the central module (2) of the barrier system.

The trolley (14) comprises two rotary wheels (15) rotating around a horizontal axis, an upper vertical arm (16), and a lower horizontal arm (17), the latter being suitable for engaging one of the barrier modules (2), in proximity of the first longitudinal end (3*a*) of the first horizontal element (3), in order to determine a partial rising of the modules (2) and putting in this way the respective rolling members (12) of at least two barrier modules (2) in a configuration in which they are in contact with the ground.

In correspondence with an end (17*a*), which is distal with respect to the axis of the wheels (15), of the lower arm (17), there is a pivot (18) suitable for engaging a respective housing obtained on the module (2) in proximity of the first longitudinal end (3*a*) of the first horizontal element (3), in a zone interposed between the projecting portions (5*a*) of two plates (5).

In correspondence with an end (16*a*) distal with respect to the axis of the wheels (15), of the upper arm 16, is arranged a handle (19) for handling the trolley (14).

When in use, the modular barrier system according to the present invention is arranged on the ground to constitute an obstacle suitable for avoiding vehicles to pass therethrough.

FIGS. 4 and 5 show, in two respective steps, the impact of a vehicle (V) against the barrier system. At first (FIG. 4)

the vehicle (V) touches with its front part one or more second upright elements (4), in such a step, if one or both the front tires of the vehicle (V) have touched the second end (3*b*) of the first horizontal element (3) and the respective beak, the elements themselves will probably be damaged and jeopardized in their function.

As shown in FIG. 5, the just described contact of the vehicle (V) with the second upright elements (4) produces, as result of the jamming in the ground of the projecting portions (5*a*) which project from the plates (5) and its respective action of pivot, the partial overturning of the barrier structure in accordance with the advancing direction of the vehicle (V).

As a matter of fact, such overturning is only partial in that one or several modules (2) will have its own first horizontal element (3) stuck below the vehicle (V). Such circumstance will increase the jamming of the barrier with the ground; should one or both the front tires had not impacted against the respective beak of a first horizontal element (3), then they will unavoidably engage the points (10) of a connecting horizontal rod (9) which connects two modules (2), and consequently they will be considerably damaged.

The installation of the barrier system takes preferably place by assembling in situ the different modules (2) by connecting the first, second and third rods (7, 8, 9) and finally joining the different modules (2) by way of a flexible thread-like cable (40) which firstly is slidingly inserted into the holes (41) and then is put under tension thanks to appropriate blocking and tensioning devices (42), of a known type, connected to the modules (2) arranged at the end of the barrier system.

The number of barrier modules (2) assembled to compose a structure is variable as a function of the extension of the zone to be protected or, in any case, of the specific needs of the moment.

The invention claimed is:

1. A modular vehicle barrier system, comprising a plurality of L-shaped barrier modules which lie on respective parallel vertical planes and connecting means between two of said barrier modules adjacent to each other, each barrier module comprising a first horizontal element, on a first end of which a second upright element rises, in the upper portion of the latter being defined holes, and anchoring means intended for their anchoring to the ground located in proximity of said first longitudinal end, configured to obstruct the sliding movement of said barrier module on the ground, characterized in that it comprises at least one flexible thread-like element which joins two or more modules, said flexible thread-like element being slidingly connected to the upright elements of at least one part of the intermediate barrier modules and being integrally connected by way of blocking and tensioning devices to the holes of the upright elements of the modules located at the ends of the barrier system, and in that said first horizontal element and second upright element are made from box-like metal profiles featuring a C-shape or quadrangular cross section.

2. The barrier system according to claim 1 wherein said flexible thread-like element slidingly pass through the holes of the upright elements of said at least one part of the intermediate barrier modules.

3. The barrier system according to claim 2 further comprising a rolling member connected to said first horizontal element in proximity of its own second longitudinal end opposite to said first longitudinal end, said rolling member being configured in such a way as to not get in contact with the ground when said first horizontal element is arranged substantially aligned with the ground.

4. The barrier system according to claim 3 wherein said first horizontal element of said barrier module is configured like a beak in correspondence with its said respective second longitudinal end and in that said beak is defined by an end edge of said first horizontal element, said rolling member being at least partially accommodated inside said box-like metal profile.

5. The barrier system according to claim 4 wherein said connecting means comprise at least one first rod and one second rod, removable and suitable for being arranged crossed to each other to connect the respective second upright elements of two adjacent barrier modules.

6. The barrier system according to claim 3 wherein said connecting means comprise at least one first rod and one second rod, removable and suitable for being arranged crossed to each other to connect the respective second upright elements of two adjacent barrier modules.

7. The barrier system according to claim 2 wherein said first horizontal element of said barrier module is configured like a beak in correspondence with its said respective second longitudinal end and in that said beak is defined by an end edge of said first horizontal element, said rolling member being at least partially accommodated inside said box-like metal profile.

8. The barrier system according to claim 7 wherein said connecting means comprise at least one first rod and one second rod, removable and suitable for being arranged crossed to each other to connect the respective second upright elements of two adjacent barrier modules.

9. The barrier system according to claim 2 wherein said connecting means comprise at least one first rod and one second rod, removable and suitable for being arranged crossed to each other to connect the respective second upright elements of two adjacent barrier modules.

10. The barrier system according to claim 2 wherein said connecting means that connect said barrier modules comprise at least one horizontal rod for connecting respective median zones of the first horizontal elements of two adjacent barrier modules.

11. The barrier system according to claim 10 wherein said horizontal rod has a plurality of points facing downwards, in such a way as to be suitable for perforating a tire should the latter get in contact therewith after a vehicle causes a partial rotation thereof upon impacting on the barrier system.

12. The barrier system according to claim 1 further comprising a rolling member connected to said first horizontal element in proximity of its own second longitudinal end opposite to said first longitudinal end, said rolling member being configured in such a way as to not get in contact with the ground when said first horizontal element is arranged substantially aligned with the ground.

13. The barrier system according to claim 12 wherein said first horizontal element of said barrier module is configured like a beak in correspondence with its said respective second longitudinal end and in that said beak is defined by an end edge of said first horizontal element, said rolling member being at least partially accommodated inside said box-like metal profile.

14. The barrier system according to claim 13 wherein said connecting means comprise at least one first rod and one second rod, removable and suitable for being arranged crossed to each other to connect the respective second upright elements of two adjacent barrier modules.

15. The barrier system according to claim 12 wherein said connecting means comprise at least one first rod and one second rod, removable and suitable for being arranged crossed to each other to connect the respective second upright elements of two adjacent barrier modules.

16. The barrier system according to claim 1 wherein said first horizontal element of said barrier module is configured like a beak in correspondence with its said respective second longitudinal end and in that said beak is defined by an end edge of said first horizontal element, said rolling member being at least partially accommodated inside said box-like metal profile.

17. The barrier system according to claim 16 wherein said connecting means comprise at least one first rod and one second rod, removable and suitable for being arranged crossed to each other to connect the respective second upright elements of two adjacent barrier modules.

18. The barrier system according to claim 1 wherein said connecting means comprise at least one first rod and one second rod, removable and suitable for being arranged crossed to each other to connect the respective second upright elements of two adjacent barrier modules.

19. The barrier system according to claim 1 wherein said connecting means that connect said barrier modules comprise at least one horizontal rod for connecting respective median zones of the first horizontal elements of two adjacent barrier modules.

20. The barrier system according to claim 19 wherein said horizontal rod has a plurality of points facing downwards, in such a way as to be suitable for perforating a tire should the latter get in contact therewith after a vehicle causes a partial rotation thereof upon impacting on the barrier system.

* * * * *